United States Patent [19]

Jastrabek

[11] 4,080,766

[45] Mar. 28, 1978

[54] DEMOUNTABLE PARTITION STRUCTURE

[75] Inventor: John Jastrabek, Bedminster, N.J.

[73] Assignee: Claremont Wall Systems Company, Inc., Bedminster, N.J.

[21] Appl. No.: 774,644

[22] Filed: Mar. 4, 1977

[51] Int. Cl.[2] ..... E04B 2/74

[52] U.S. Cl. ..... 52/242

[58] Field of Search ..... 52/238, 239, 241, 242, 52/248, 221, 729

[56] References Cited

U.S. PATENT DOCUMENTS

| | | | |
|---|---|---|---|
| 178,076 | 5/1876 | Nostrand | 52/729 |
| 3,217,452 | 11/1965 | Steele | 52/242 |
| 3,292,328 | 12/1966 | Lewis | 52/481 X |
| 3,293,813 | 12/1966 | Emmons | 52/481 |
| 3,387,418 | 6/1968 | Tyrer | 52/242 |
| 3,708,607 | 1/1973 | Brode | 52/221 |
| 3,830,027 | 8/1974 | Paisley | 52/241 |

*Primary Examiner*—John E. Murtagh
*Attorney, Agent, or Firm*—George H. Mitchell, Jr.

[57] ABSTRACT

A demountable partitioning system for offices and the like includes an elongated floor channel member provided with teeth which engage the carpeting to ensure stability, with a series of snap-in supporting members which define a floor level raceway for service utilities and also support wallboard panels in horizontally spaced relationship above the raceway, whereby partitions can be dismantled and rearranged without damaging the existing building.

9 Claims, 11 Drawing Figures

FIG 1
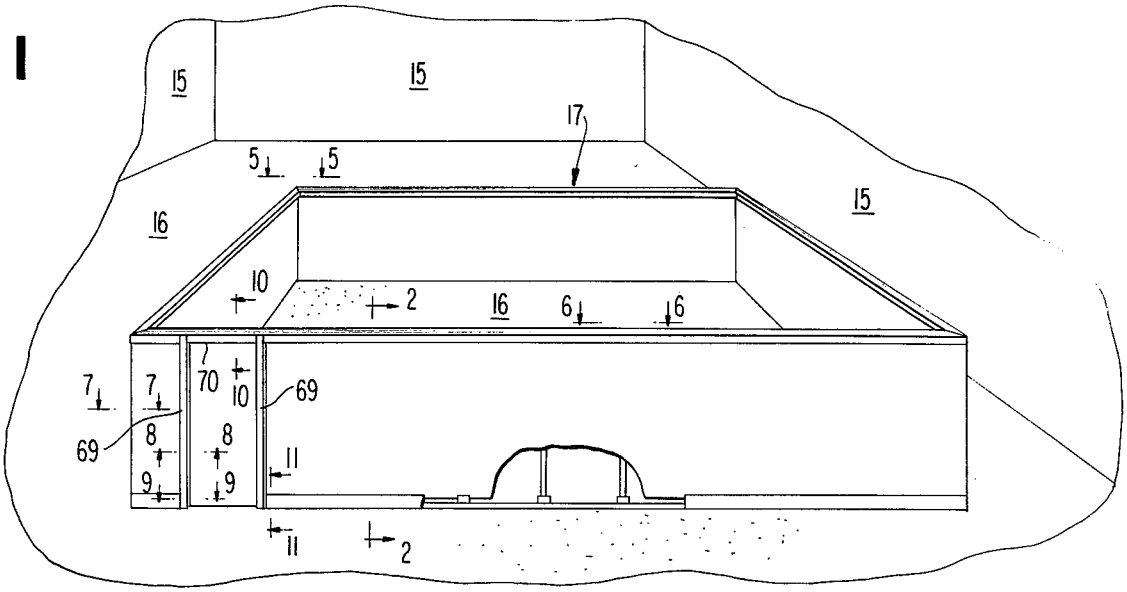
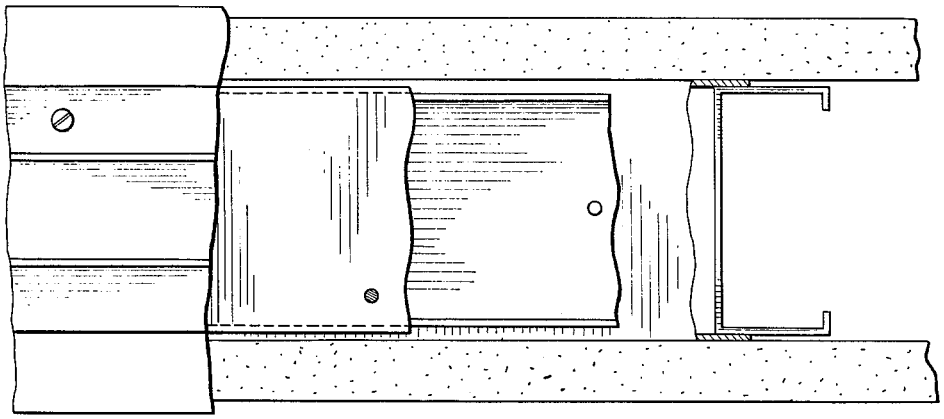
FIG 6
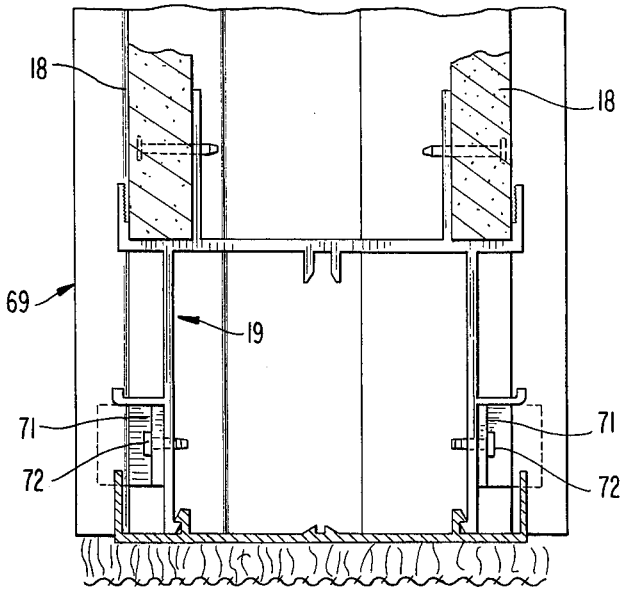
FIG 11

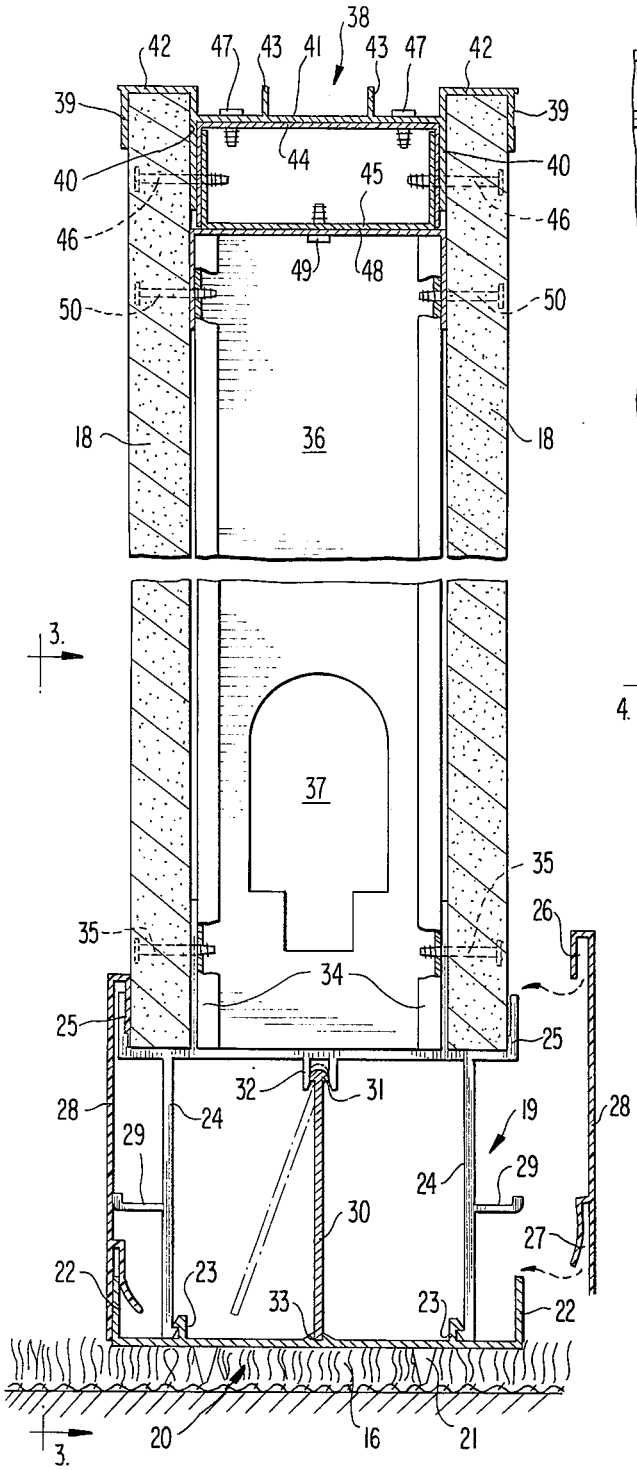
FIG 2
FIG 4
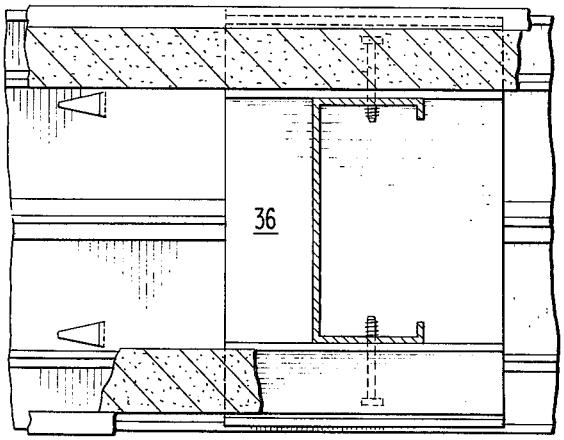
FIG 3
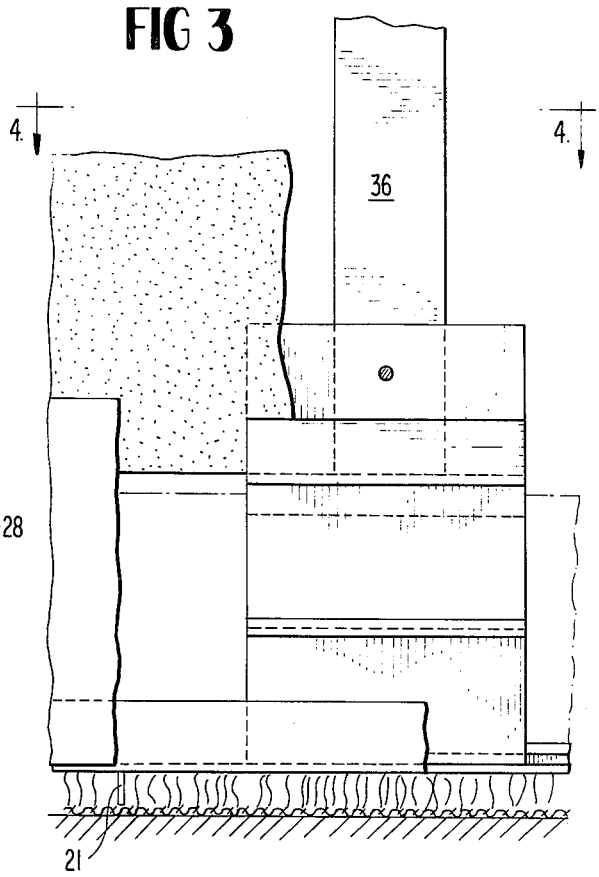
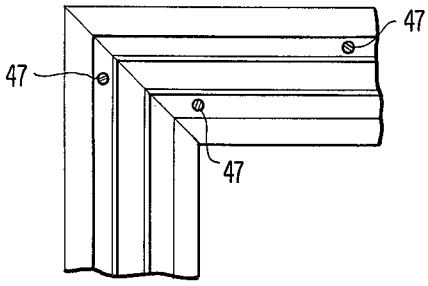
FIG 5

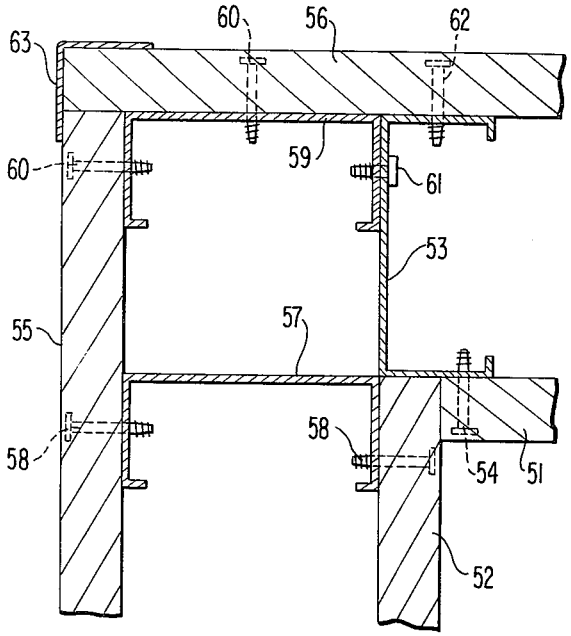
FIG 7
FIG 8
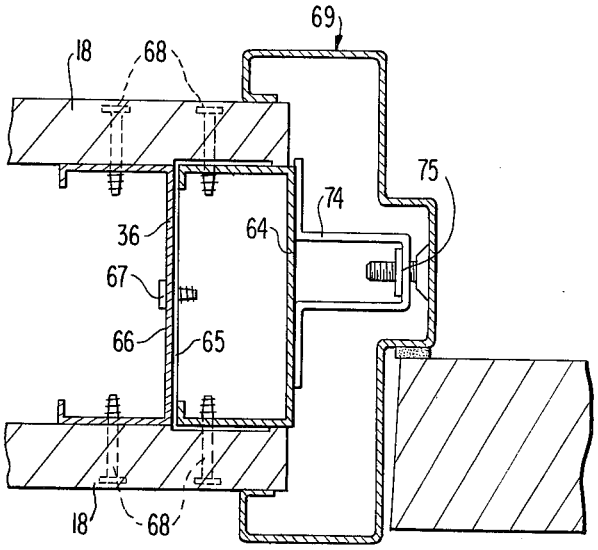
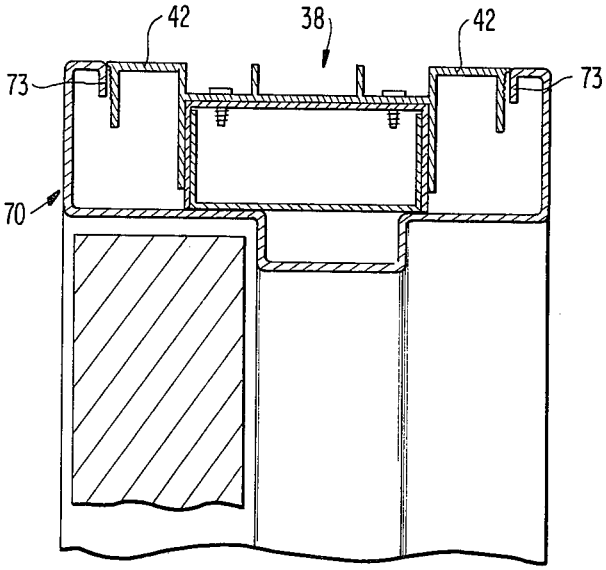
FIG 10
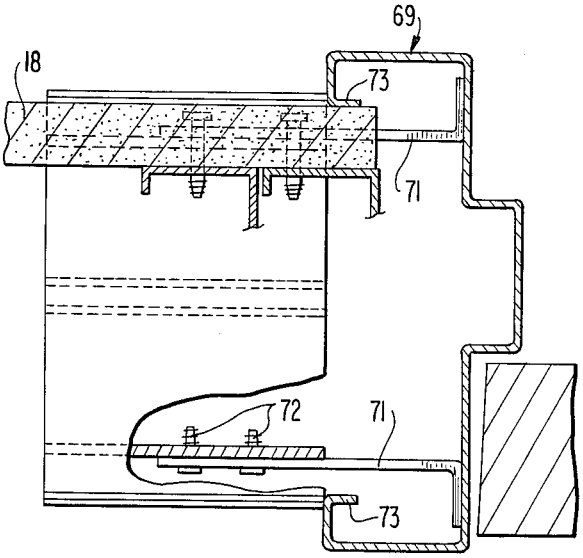
FIG 9

DEMOUNTABLE PARTITION STRUCTURE

This invention relates to improvements in partitioning systems for erecting and dismantling wall sections for subdividing space in an exclosure such as an office building.

Partitioning systems of this general type are disclosed in U.S. Pat. Nos. 2,313,839, Olsen, Mar. 16, 1943; 3,034,609, Young, May 15, 1962; 3,217,452, Steele, Nov. 16, 1965; and 3,255,563, Sauer, June 14, 1966.

However, it is an object of the present invention to provide a demountable partitioning system which includes an elongated floor channel member having teeth which enable it to grip a carpet in a non-destructive way which enables the system to be shifted from time to time in accordance with changing requirements without the necessity for cutting, repairing or replacing portions of the carpet.

Still another object of the invention is to provide an easily assembled door frame for a demountable partitioning system by attaching hat-shaped bent metal to the studs which define the door opening.

A still further object of the invention is to provide a demountable partitioning system having a series of wall panel supporting members which define a raceway for electrical wiring at floor level and which snap into locking engagement with an elongated floor channel member.

Other objects and advantages will be apparent to those skilled in the art after reading the following specification in connection with the annexed claims, in which:

FIG. 1 is an isometric view of a preferred form of demountable wall system according to the present invention used to form a four-sided, free-standing enclosure in a carpeted building;

FIG. 2 is a vertical section taken on the line 2—2 of FIG. 1;

FIG. 3 is a fragmentary side elevation adjacent the floor with a portion of baseboard and wallboard broken away;

FIG. 4 is a horizontal section taken on the line 4—4 of FIG. 3;

FIG. 5 is a plan view looking down on the top of a corner of the enclosure from the level indicated by line 5—5 of FIG. 1;

FIG. 6 is a fragmentary plan view of a straight portion of the enclosure looking down from the level of the line 6—6 of FIG. 1 with portions of the supporting section broken away;

FIG. 7 is a horizontal section of the corner construction taken on the line 7—7 of FIG. 1; FIG. 8 is a horizontal section of the door buck jamb taken on line 8—8 of FIG. 1;

FIG. 9 is a section taken on line 9—9 of FIG. 1;

FIG. 10 is a vertical section taken on line 10—10 of FIG. 1, and;

FIG. 11 is a fragmentary vertical section taken on line 11—11 of FIG. 1.

In FIG. 1 of the drawings an enclosure is shown, which may be an office building, or warehouse, having exterior walls 15 and a floor, covered from wall to wall by a carpet 16 which is to be subdivided into smaller units of space by means of a free-standing, demountable partitioning system, indicated generally by numeral 17.

As can be seen in FIG. 2, the partitioning system comprises essentially a series of panels 18 of wallboard, or gypsum, supported in end-to-end relationship in two parallel, spaced planes on a plurality of panel supporting members, indicated generally by numeral 19, which, in turn, are placed at regularly spaced intervals on an elongated, extruded metal floor channel 20 which is held in position by downwardly projecting teeth 21, which are punched out from the channel members to be embedded in the carpet 16. Since these teeth are placed at intervals of six inches or so along the length of the floor channel and the entire weight of the partition is carried by the channel, no other securing means is required to prevent horizontal shifting of the partition and, at the same time, there is no permanent disfigurement of the carpet or floor if it later becomes desirable to move the partition.

In addition to the two upwardly extending flanges 22, the channel 20 also includes two longitudinal tracks 23 provided with outwardly and downwardly directed undercut horizontal ledges which interengage with similar upwardly and inwardly facing ledges at the lowermost margins of the downwardly projecting legs 24 of the members 19. The height of these legs is such that they not only provide space for a raceway to accommodate utility wiring below the bottom of panels 18, but permit the members 24 to be easily snapped into engagement with the tracks 23 in locking relationship. Members 19 are also provided with upwardly directed exterior flanges 25 in vertical alignment with base flanges 22, in order to provide detachable support for flanges 26 and 27 formed on the inner side of the baseboards 28 which are preferably formed of extruded plastic material. Outwardly projecting horizontal webs 29 may be integrally formed on legs 24 to provide bracing for the baseboard. In addition, to reduce sound transmission from one side of the wall to the other, an elongated strip 30 may be provided, having an enlarged bead 31 along the upper edge which slides upwardly into a central channel 32 on the lower face of member 19 from the dotted line position shown in FIG. 2, the lower edge of the strip fitting into the raised groove 33 on the floor channel. The panel supporting members 19 are also provided with upstanding inner flanges 34, spaced from flanges 25 to provide a snug fit for the lower edge of panels 18 and projecting upwardly a sufficient distance to receive drywall screws 35 which are inserted from the exterior of the panels 18 and serve to also secure the lower ends of a C-shaped vertical bent metal stud 36, which may have a space 37 punched out for electrical wiring to pass through.

The top of the partition comprises an elongated, extruded cap member, indicated generally by numeral 38, which includes downwardly directed outer and inner flanges 39 and 40, for snug engagement with the upper margins of panels 18. The central horizontal web 41 of the cap is dropped below the end portions 42 to form a pair of molding to support picture hooks (not shown) if desired, and the upwardly directed flanges 43 will receive a further vertical panel (not shown) which can extend to the ceiling if the panels 18 fall short. To reinforce the upper margin of the partition, a pair of nested, oppositely facing C-shaped elongated 20 gauge metal 44 and 45 are placed between the upper ends of the studs 36 and the cap 38. The channel members 44 and 45 are secured to the cap 38 by horizontal drywall screws 46 which pass through flanges 40 and by sheet metal screws 47, while downwardly facing channel members 48, placed between the channel 45 and the top of the studs 36, are secured by sheet metal screws 49 to channel 45 and to the panels 18 by drywall screws 50.

A typical corner assembly is shown in FIGS. 5 and 7, in which it will be observed that the caps 47 are cut at a 45° angle so as to intersect at the corner. The floor channel members 22 (not shown) are also similarly mitered. On the other hand, one of the inner drywall panels 51 is butted up against the side of the panel 52 coming at right angles to panel 51, with the end panel 52 butted against one leg of a C-shaped, bent metal stud 53, which is secured to panel 51 by drywall screws 54. Outer panel 55 extends beyond inner panel 52 by a distance equal to the width of stud 53 and abuts against the side of exterior panel 56 coming from the other direction. Further reinforcement of the corner is obtained by the presence of bent, C-shaped metal stud 57, secured between panel 55 and the end panel 52 by drywall screws 58, and a similar stud 59 which lies flat against the end portion of panel 56. Stud 59 is secured to panel 55 and 56 by drywall screws 60 and to stud 53 by sheet metal screws 61. Finally, panel 56 is also attached to the side of stud 53 by drywall screws 62, and the exterior corner may be protected by a plastic or metal L-shaped channel member 63, which preferably is wide enough to cover the joint between the two panels.

A typical door installation is shown in FIGS. 8–10, in which the drywall panels 18 are reinforced adjacent the door frame by two nested, oppositely facing C-shaped metal studs 64 and 65, with an additional, outwardly facing C-shaped metal stud 66, joined to stud 65 by sheet metal screws 67, the studs being secured to panels 18 by drywall screws 68. A pair of vertical door buck jambs 69 and a horizontal door buck head 70 are cut from a 186A bent steel which has a generally hat-shaped configuration. The vertical jambs 69 extend from the floor to the level of the upper web 42 of the cap 48 and the ends of the head 70 are cut off at right angles to abut against the inner faces of the upper extremities of vertical jambs 69 for a purpose which will be explained. At the base of each of the vertical jambs 69, a pair of horizontal metal strips 71 are pressure fitted at one end to the inner web so that the other ends may be attached by sheet metal screws 72 to the adjacent panel supporting member 19 to position a hat-shaped member 69 with the inward reentrantly turned flanges 73 lying flush against the exterior surfaces of the panels 18. Near the top of the doorway, a saddle shaped clip is connected with the outwardly projecting section of jamb 69 by means of a Grip-Lok adjusting nut 75 whereby adjustment of this nut will cause the jamb 69 to be urged inwardly towards the right as viewed in FIG. 8 which, in turn, exerts inward pressure on the end of the head 70 to hold it in place with its flanged extremity 73 in alignment with the webs 42 of the continuously extending cap 38.

What is claimed is:

1. In a demountable assembly of the type wherein a plurality of wall panels are positioned in edge-to-edge alignment in two horizontally spaced parallel vertical planes by means of a series of panel supporting members carried at spaced intervals along the length of an elongated extruded floor channel placed at any chosen location on a carpeted floor surface for mounting the lower ends of the wall panels elevated above said floor surface to provide with said floor channel a longitudinal raceway for utilities at floor level, the improvement which comprises said wall supporting members being provided with two horizontally spaced pairs of upwardly directed flanges to receive the lower edges of two wall panels and being also provided with a pair of horizontally spaced legs each projecting downwardly beneath a respective one of said pairs of flanges to confine said utilities within the space below said panels, the lower ends of said legs beings provided with horizontally oppositely directed lugs for snap-in locking engagement with the oppositely directed flanges of a trackway formed in said floor channel, said floor channel also being provided with downwardly directed, non-destructive, gripping means for detachable non-slipping engagement with said carpeted-floor surface.

2. The invention as claimed in claim 1, wherein said assembly also includes a baseboard, said baseboard being provided with downwardly directed projecting flanges for engagement with a flange on the floor channel and panel supporting member respectively, to removably support the baseboard.

3. The invention as claimed in claim 1, wherein said panel supporting members include a horizontal web to support the lower end of a vertical stud extending between said spaced panels, above said raceway.

4. The invention as claimed in claim 3, wherein the lower face of said web and the upper face of said floor channel are provided with longitudinal grooves to removably receive a vertical elongated strip.

5. The invention defined in claim 1, wherein said assembly includes an elongated top cap member provided with means for engagement with the upper margins of said wall panels and said assembly also includes means connected with the ends of said top cap member to prevent lateral displacement thereof.

6. The invention defined in claim 1 wherein said top cap member includes means for engagement with the lower margin of a panel member to extend vertically above the top cap member.

7. The invention defined in claim 6 wherein said means for engagement with the lower margin of a panel comprises a pair of upstanding flanges defining a horizontal slot for the margin of said panel.

8. The invention defined in claim 6 wherein said means for engagement with the upper margins of said wall panels comprises two pairs of downwardly projecting laterally spaced flanges defining grooves to receive said margins.

9. The invention defined in claim 8 wherein said two pairs of downwardly projecting flanges are joined by a horizontal web spaced below the upper ends of the flanges whereby the inverted flanges define a pair of longitudinal horizontal moldings.

* * * * *